US006359053B1

(12) United States Patent
Chen

(10) Patent No.: US 6,359,053 B1
(45) Date of Patent: Mar. 19, 2002

(54) COCKTAIL-TYPE POSITIVE TEMPERATURE COEFFICIENT (PTC) POLYMER BLEND COMPOSITION AND CIRCUIT PROTECTION DEVICE

(75) Inventor: Jack Jih-Sang Chen, Taipei (TW)

(73) Assignee: Fuzetec Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 09/667,343

(22) Filed: Sep. 22, 2000

(51) Int. Cl.[7] ..... H01B 1/06

(52) U.S. Cl. ..... 524/495; 252/511

(58) Field of Search ..... 524/495; 252/511

(56) References Cited

U.S. PATENT DOCUMENTS 4,576,993 A * 3/1986 Tamplin ..... 525/240
6,265,455 B1 * 7/2001 Braga ..... 521/92

* cited by examiner

*Primary Examiner*—Paul R. Michl
(74) *Attorney, Agent, or Firm*—Merchant Gould P.C.

(57) ABSTRACT

A cocktail-type positive temperature coefficient (PTC) polymer blend composition, and a circuit protection device including a PTC element made from the cocktail-type positive temperature coefficient (PTC) polymer blend composition are disclosed. The composition includes a polymer mixture, containing a crystalline grafted polymer, a crystalline non-grafted polymer and an ionomer of an ionic copolymer of said crystalline non-grafted polymer and an ionized unsaturated carboxylic acid, and a conductive particulate material.

18 Claims, No Drawings

COCKTAIL-TYPE POSITIVE TEMPERATURE COEFFICIENT (PTC) POLYMER BLEND COMPOSITION AND CIRCUIT PROTECTION DEVICE

BACKGROUND OF THE INVENTION

1. Field of the Invention

The present invention relates to a cocktail-type positive temperature coefficient (PTC) polymer blend composition and a circuit protection device including a PTC element made from the cocktail-type positive temperature coefficient (PTC) polymer blend composition.

2. Description of the Related Art

In recent years, positive temperature coefficient (PTC) polymer materials have been wildly applied to automatic limiting heating cables, over-current protection devices e.g. thermistors, touch-control elements, and the like. Due to the extensive development, application and dissemination of electronic products, such as computers and peripheral equipments thereof, cellular phones, secondary rechargeable batteries, network interface boards/machines, modems and electronic facilities and so on, the need for over-current protection devices has remarkably increased. Particularly, the trend for present electronic products is to be light, delicate and accurate, and the characteristics of the over-current protection device made from PTC polymer materials are adapted to meet this trend.

PTC polymer materials primarily are prepared by the addition of conductive additives, such as carbon black and metal powders, to polymer materials. They are generally characterized by an increase in resistance as the operating temperature rises. In particular, when the operating temperature rises around and above the melting point of the PTC polymer material, the resistance increases sharply and logarithmically because of the sharp volume expansion, thus achieving an almost insulated condition. Such a phenomenon is a physical change of the PTC polymer material and is reversible and recurrent and thus, the PTC polymer material is suitable for application to a circuit protection device, such as a thermistor.

PTC polymer materials and circuit protection devices made therefrom have been disclosed in the following patents: U.S. Pat. Nos. 4,237,441, 4,304,987, 4,318,881, 4,226,633, 4,534,889, 4,560,498, 4,845,838, 5,227,946, 5,580,493, 5,747,147, 5,801,612, 3,351,882, 4,689,475, 4,800,253, 5,874,885, 5,940,958, 5,864,280, 5,800,668, and 6,059,997. These prior patents are incorporated herein for reference.

In a conventional circuit protection device made from the PTC polymer material, the PTC polymer material is used for forming a base. Metal foils are laminated or coated on the upper and lower sides of the base to act as electrodes. A conductive wire carrier or conductive sheet is connected to the outer side of the metal foils for enhanced connectivity.

Generally, the polymer materials used in the prior circuit protection devices include polyolefin, such as polyethylene and polypropylene, copolymers of polyolefin and derivatives thereof, such as EVA, EBA, EAA, EMAA, and EMA, and the mixture of polyolefin and copolymers of polyolefin and derivatives thereof. However, there are some defects in the application of the prior polymer materials. For instance, the adhesion of polyolefin to the metal foil electrodes is very poor. The polyolefin adhered to the electrodes is of poor processability and easily peels off, and the contact resistance between the polyolefin and the surface of the electrodes is very high. Although the adhesion to the electrodes can be improved by the use of the copolymer of the polyolefin and derivatives thereof, the crystallinity of the copolymer of the polyolefin and derivatives thereof is relatively low and thus, the volume resistivity of the copolymer of the polyolefin and derivatives thereof rises accordingly. In other words, if a low volume resistivity is to be maintained, the amount of the conductive additives contained in the copolymer of the polyolefin and derivatives thereof has to be increased, but the physical properties of the thus formed copolymer composition will become relatively poor. Furthermore, on the basis of trip current being a function of heat transfer which is in terms of a function of melting point of polymer and polymer blends, since the melting point of the copolymer of the polyolefin and derivatives thereof (about 60° C. to 100° C.) is lower than that of polyolefin (about 125° C. to 135° C.) by 35° C. to 75° C., the trip current of the circuit protection device made from such a copolymer will accordingly decrease. In addition, although the adhesion of the mixture of polyolefin and the copolymer of polyolefin and derivatives to the electrodes is improved relative to that of polyolefin, such a mixture also undesirably includes some defects of the copolymer of polyolefin and derivatives thereof.

In view of the above defects, improvements by the use of metal foil electrodes of particular specifications to advance the adhesion property and the processability and to decrease the surface contact resistance have been disclosed in the prior art. U.S. Pat. No. 3,351,882 (Kohler et al.) discloses the use of electrodes of meshed construction to improve the adhesion of polymer materials to electrodes. However, in the disclosed device, the contact resistance between polymer materials and the surface of electrodes is high, and the distribution of current/voltage is uneven.

JP Kokai No. 5-10952 discloses the use of electrodes of a porous metal material having a three-dimensional network structure. However, such electrodes result in high resistance because of the difficulty in connecting a wire carrier.

U.S. Pat. Nos. 4,689,475 and 4,800,253 (Kleiner et al.) disclose a metal foil electrode having a chemically or mechanically micro-roughened surface. However, the roughened process increases the procedure complexity and cost of manufacture.

U.S. Pat. No. 5,874,885 discloses the use of two-layer metal foils including a base comprised of a first metal and protrusions on the base and comprised of a second metal so as to provide surface-roughened metal foil electrodes. Similarly, the roughened process increases the procedure complexity and cost of manufacture.

U.S. Pat. Nos. 5,955,936 and 5,940,958 disclose the use of electrodes characterized by a plurality of voids and made of foam. However, the production of such electrodes increases the procedure complexity and cost of manufacture.

U.S. Pat. Nos. 5,864,280, 5,880,668 and 6,059,997 disclose a crystalline PTC polymer composition, comprising a modified polyolefin and a conductive particulate filler, wherein the modified polyolefin is grafted to the conductive particulate filler. The modified polyolefin is a carboxylic acid-grafted polyolefin. The graft reaction between the modified polyolefin and the conductive particulate filler is carried out at a temperature of 240° C. so as to allow the esterification between the carboxyl group of the modified polyolefin and the conductive particulate. The resultant circuit protection device made from the crystalline PTC polymer composition has good resistance stability. However, the graft reaction between the modified polyolefin and the conductive particulate filler has to be conducted at a temperature of 240° C., in close proximity to the critical operating temperature of the used grafted-polyolefin, and thus, the adverse effect, i.e. the decomposition of the carboxylic acid-grafted polyolefin into the carboxylic acid and the polyolefin, is likely to happen. Moreover, the graft temperature of the modified polyolefin and the conductive particulate filler, 240° C., is higher than the common operating temperature, 180° C. to 200° C., by up to 60° C. and increases the difficulty of the compounding process and graft reaction process of the composition.

In addition, the graft level and the uniformity of the modified polyolefin and the conductive particulate filler are difficult to be determined and thus, result in the uncertain yield of the resultant composition and the circuit protection device made therefrom.

There is thus a need for a PTC polymer composition which can be easily produced, and which has a good adhesion to electrodes and a good PTC behavior.

SUMMARY OF THE INVENTION

Therefore, it is an object of the present invention to provide a cocktail-type positive temperature coefficient (PTC) polymer blend composition, which is useful in the manufacture of a circuit protection device and which is capable of providing an improved PTC behavior.

According to one aspect of the present invention, there is provided a cocktail-type PTC polymer blend composition, comprising (a) a polymer mixture containing: (i) a crystalline grafted polymer selected from a group consisting of grafted polyolefin, grafted polyolefin derivatives, and grafted copolymers of polyolefin and polyolefin derivatives, the grafted polymer being grafted by a polar group selected from a group consisting of carboxylic acids and derivatives thereof, (ii) a crystalline non-grafted polymer selected from a group consisting of non-grafted polyolefin, non-grafted polyolefin derivatives, and non-grafted copolymers of polyolefin and polyolefin derivatives, the non-grafted polymer having a melting point substantially the same as that of the grafted polymer, and (iii) an ionomer of an ionic copolymer of the crystalline non-grafted polymer and an ionized unsaturated carboxylic acid; and (b) a conductive particulate material.

According to another aspect of the present invention, there is provided a circuit protection device, comprising (a) a PTC element, having the aforesaid cocktail-type PTC polymer blend composition; and (b) two electrodes, connected respectively to two opposite sides of the PTC element and adapted to be connected a power source.

DETAILED DESCRIPTION OF THE INVENTION

This invention provides a PTC polymer blend composition, which has an improved adhesion to electrodes and an improved PTC behavior, i.e. low contact resistance, low initial resistance, high trip current, high peak volume resistance, high stability and a peel strength comparable to that of the prior art, and a circuit protection device of high resistance uniformity and high production yield.

The cocktail-type PTC polymer blend composition of this invention comprises a polymer mixture including a crystalline grafted polymer grafted by a polar group, a crystalline non-grafted polymer, and an ionomer of an ionic copolymer of the crystalline non-grafted polymer and an ionized unsaturated carboxylic acid, and a conductive particulate material.

The crystalline grafted polymer is selected from a group consisting of grafted polyolefin, grafted polyolefin derivatives and grafted copolymers of polyolefin and polyolefin derivatives. Preferably, the crystalline grafted polymer is selected from the group consisting of grafted high density polyethylene (HDPE), grafted low density polyethylene (LDPE), grafted linear low density polyethylene (LLDPE), grafted medium density polyethylene (MDPE), and grafted polypropylene (PP). More preferably, the crystalline grafted polymer is grafted HDPE. Preferably, the grafted copolymer of polyolefin and polyolefin derivatives is selected from a group consisting of grafted EVA, grafted EBA, grafted EAA, grafted EMAA, and grafted EMA.

The polar group grafted to the crystalline grafted polymer is selected from the group consisting of carboxylic acid and derivatives thereof. Preferably, the polar group is selected from the group consisting of maleic anhydride, acrylic acid, and acetic acid. More preferably, the polar group is maleic anhydride.

More preferably, the melting point of crystalline grafted polymer is substantially the same as that before grafting.

The crystalline non-grafted polymer is selected from a group consisting of non-grafted polyolefin, non-grafted polyolefin derivatives, and non-grafted copolymers of polyolefin and polyolefin derivatives. Preferably, the crystalline non-grafted polymer is selected from the group consisting of non-grafted HDPE, non-grafted LDPE, non-grafted LLDPE, non-grafted MDPE, and non-grafted PP. More preferably, the crystalline non-grafted polymer is non-grafted HDPE. Preferably, the non-grafted copolymer of the polyolefin and the polyolefin derivatives is selected from a group consisting of non-grafted EVA, non-grafted EBA, non-grafted EAA, non-grafted EMAA, and non-grafted EMA.

The ionomer of an ionic copolymer of the crystalline non-grafted polymer and an ionized unsaturated carboxylic acid is characterized by having the cross-linking polymer property at room temperature and having flowability of the plastic polymer when melted. Therefore, the PTC material thus made has excellent mechanical properties, such as toughness, good low temperature toughness, high impact strength, and high elasticity. Furthermore, since the ionomer is polar, the PTC material made therefrom has a good adhesion to the metal foil electrodes and hence, the circuit protection device thus made has a low contact resistance so as to eliminate the peeling off of the electrodes from the cocktail-type PTC polymer blend composition and to improve the processability. In addition, the polar ionomer has good wettability and dispersivity in the conductive particulate material and an electrical stability and thus, will improve the yield and stabilize the trip current and resistance of the circuit protection device thus made.

The unsaturated carboxylic acid included in the ionomer is selected from a group consisting of maleic anhydride, acrylic acid and acetic acid. Preferably, the unsaturated carboxylic acid is acrylic acid.

The ionized unsaturated carboxylic acid is ionized by neutralization with a metal ion selected from a group consisting of sodium, potassium, zinc, calcium, magnesium, lithium, aluminum, nickel and chromium.

The conductive particulate material is selected from a group consisting of carbon black, graphite, carbon fiber and metal powder. The metal powder has a diameter of 0.01 $\mu$m to 100 $\mu$m, and is selected from a group consisting of Ni, Cu, Al, Ag, Au, Fe, Pb, Sn and Zn. Preferably, the conductive particulate material is carbon black and has a structure grade <120, which is measured by the oil (DiButyl Phthalate) absorption method, and a particle size of 40–100 nm.

The cocktail-type PTC polymer blend composition of the present invention comprises 30%–70% by weight the polymer mixture and 30% to 70% by weight the conductive particulate material. Preferably, the cocktail-type PTC polymer blend composition of the present invention comprises 40%–60% by weight the polymer mixture and 40% to 60% by weight the conductive particulate material. More preferably, the cocktail-type PTC polymer blend composition of the present invention comprises 50% by weight the polymer mixture comprised of grafted HDPE, non-grafted HDPE, and Surlyn 8670 (a commercial product available from DuPont), and 50% by weight the conductive particulate material consisted of carbon black.

In the cocktail-type PTC polymer blend composition of the present invention, the polymer mixture comprises 10% to 80% by weight the crystalline grafted polymer, 10% to 80% by weight the crystalline non-grafted polymer, and 10–80% by weight the ionomer. Preferably, the polymer mixture comprises 30–50% by weight the crystalline grafted polymer comprised of grafted HDPE, 25–35% by weight of the crystalline non-grafted polymer comprised of non-grafted HDPE, and 25–35% by weight Surlyn 8670.

The invention will now be specifically described with reference to the following examples which are not meant to limit the scope of this invention.

PTC Behavior

EXAMPLES 1–2

According to the amounts listed in table 1, a grafted PE (Fusabond, from DuPont), which was grafted by 1% by weight maleic anhydride, an on-grafted HDPE, an ionomer (Surlyn 8670), and carbon black were placed in a C.B. Barbender Plasti-Corder, sequentially, and compounded at a temperature of 190° C. for 4–8 minutes at 30–40 rpm. A suitable amount of the resultant composition, approximately 6 g, was then compressed and molded by a thermal press, at 190° C. for 4–8 minutes, into a sheet having a thickness of about 0.5 mm. The sheet was moved out and placed between two copper foils having a thickness of 0.035–0.0675 mm and a weight of 0.5–1.0 oz. The combination of the sheet and the copper foils was then placed into a compression hot plate mold having a thickness of about 0.5 mm, and subsequently in a compression press for 4–8 minutes. The resultant thin plate underwent the cross-linking reaction under a dosage of 15 mR and then cut into a number of 0.3 $cm^2$ electrical devices so as to carry out the characteristic analysis. The results of the characteristic analysis are set forth in table 2.

Comparative Examples 1–5

The compositions and electrical devices of comparative Examples 1–5 were produced in substantially the same manner as that of Example 1 except that the compositions were varied as set forth in table 1. The characteristic analysis of Example 1 was followed, and the results are set forth in table 2.

TABLE 1

| Composition Wt % | Non-grafted HDPE (wt %) | Grafted PE (wt %) | Ionomer (Surlyn 8670) (wt %) | Carbon black (wt %) |
|---|---|---|---|---|
| Example 1 | 25.0 | 12.5 | 12.5 | 50.0 |
| Example 2 | 16.7 | 16.7 | 16.6 | 50.0 |
| Comparative Example 1 | 50.0 | — | — | 50.0 |

TABLE 1-continued

| Composition Wt % | Non-grafted HDPE (wt %) | Grafted PE (wt %) | Ionomer (Surlyn 8670) (wt %) | Carbon black (wt %) |
|---|---|---|---|---|
| Comparative Example 2 | — | — | 45.0 | 55.0 |
| Comparative Example 3 | — | — | 40.0 | 60.0 |
| Comparative Example 4 | — | 50.0 | — | 50.0 |
| Comparative Example 5 | — | 45.0 | — | 55.0 |
| Comparative Example 6 | — | 40.0 | — | 60.0 |
| Comparative Example 7 | 25.0 | — | 25.0 | 50.0 |
| Comparative Example 8 | 22.5 | — | 22.5 | 55.0 |
| Comparative Example 9 | 20.0 | — | 20.0 | 60.0 |

TABLE 2

| Example | $R_i$[1] (ohm) | $R_{peak}$[2] (ohm) | Log ($R_{peak}/R_i$) | $I_A$[3] (amp) | Peel strength[4] (kg, cm) |
|---|---|---|---|---|---|
| Example 1 | 0.288 | 5100 | 4.25 | 1.25 | 1.27 |
| Example 2 | 0.390 | 252000 | 5.81 | 1.02 | 1.43 |
| Comparative Example 1 | 0.354 | 7480 | 4.33 | 0.70 | 0.27 |
| Comparative Example 2 | 3.790 | 9670 | 3.41 | 0.18 | 0.67 |
| Comparative Example 3 | 0.416 | 1700 | 3.61 | 0.73 | 0.49 |
| Comparative Example 4 | 0.987 | 170000 | 5.25 | 0.59 | 1.68 |
| Comparative Example 5 | 0.192 | 65000 | 5.53 | 1.02 | 1.90 |

Note:

[1] $R_i$ (ohm), initial resistance, measured by microhmmeter, four-point method

[2] $R_{peak}$ (ohm), peak resistance

[3] $I_A$ (amp), trip current

The minimum current flow through the tested devices to trip the device, namely, the current at which the thermistor changes its state of conductivity to high resistance

[4] Peel strength (kg per linear cm)

The force required to peel off the metal foil having a width of 1 cm, measured by the universal tension meter.

From the results shown in table 2, the cocktail-type PTC polymer blend composition of the present invention, when applied to circuit protection devices, can provide an improved PTC behavior, i.e. low contact resistance, low initial resistance, high trip current, high peak resistance, high conductivity and a peel strength comparable to that of the prior art.

Resistance Uniformity and Production Yield of the Circuit Protection Device

Each of the 0.3 $cm^2$ electrical devices obtained from Examples 1 and 2 was connected to the lead, soldered with tin, and surface-coated with epoxy. The initial resistance of each of the resultant devices was measured so as to evaluate the resistance uniformity and production yield.

Each of the 0.3 $cm^2$ electrical devices obtained from Comparative Examples 4–6 was connected to the lead, soldered with tin, and surface-coated with epoxy. The initial resistance of each of the resultant devices was measured so as to evaluate the resistance uniformity and production yield.

Comparative Examples 7–9

The compositions and electrical devices of Comparative Examples 7–9 were produced in substantially the same manner as that of Example 1 except that the compositions were varied as set forth in table 1. Each of the 0.3 $cm^2$ electrical devices thus made was connected to the lead, soldered with tin, and surface-coated with epoxy. The initial resistance of each of the resultant devices was measured so as to evaluate the resistance uniformity and production yield.

The standard derivation and average of the initial resistance of the devices obtained from Examples 1–2 and Comparative Examples 4–9 are listed in Table 3.

TABLE 3

| Sample No. | Example 1 | Example 2 | Comparative Example 4 | Comparative Example 5 | Comparative Example 6 | Comparative Example 7 | Comparative Example 8 | Comparative Example 9 |
|---|---|---|---|---|---|---|---|---|
| 1 | 1.063 | 0.826 | 47.960 | 3.180 | 0.474 | 2.030 | 2.030 | 0.860 |
| 2 | 0.815 | 0.840 | 14.460 | 2.280 | 0.715 | 2.280 | 1.720 | 0.751 |
| 3 | 0.770 | 0.882 | 29.453 | 2.020 | 0.429 | 2.530 | 1.400 | 0.530 |
| 4 | 0.969 | 0.774 | 61.250 | 2.440 | 0.590 | 2.460 | 1.860 | 0.770 |
| 5 | 0.875 | 0.995 | 47.990 | 2.510 | 0.403 | 2.040 | 2.200 | 0.590 |
| 6 | 0.959 | 0.727 | 44.540 | 2.460 | 0.264 | 2.000 | 1.610 | 0.720 |
| 7 | 0.807 | 0.766 | 25.610 | 2.850 | 0.317 | 2.200 | 1.270 | 0.630 |
| 8 | 0.889 | 0.813 | 15.560 | 1.890 | 0.571 | 2.850 | 1.530 | 0.610 |
| 9 | 0.966 | 0.759 | 27.280 | 2.040 | 0.488 | 2.150 | 1.830 | 0.820 |
| 10 | 0.798 | 0.795 | 20.180 | 2.290 | 0.477 | 1.910 | 1.260 | 0.710 |
| 11 | 0.977 | 0.885 | 18.720 | 1.760 | 0.491 | 1.620 | 1.790 | 0.870 |
| 12 | 0.823 | 0.944 | 44.330 | 2.410 | 0.278 | 2.470 | 1.470 | 0.760 |
| 13 | 0.838 | 0.821 | 26.720 | 1.800 | 0.571 | 1.860 | 1.440 | 0.830 |
| 14 | 0.833 | 0.856 | 23.280 | 1.980 | 0.512 | 3.210 | 2.180 | 0.860 |
| 15 | 0.685 | 0.789 | 47.190 | 3.020 | 0.384 | 1.930 | 1.030 | 0.960 |
| 16 | 0.787 | 0.833 | 34.900 | 2.180 | 0.928 | 2.120 | 1.950 | 0.820 |
| 17 | 0.739 | 0.738 | 34.290 | 2.350 | 0.588 | 2.270 | 1.850 | 0.760 |
| 18 | 0.932 | 0.802 | 42.890 | 2.330 | 0.379 | 2.440 | 1.390 | 0.780 |
| 19 | 0.842 | 0.809 | 21.470 | 2.580 | 0.476 | 2.720 | 2.120 | 0.960 |
| 20 | 0.793 | 0.985 | 76.460 | 2.660 | 0.392 | 2.670 | 1.450 | 0.480 |
| 21 | 0.822 | 0.892 | 45.290 | 3.450 | 0.542 | 2.150 | 1.570 | 0.860 |
| 22 | 0.835 | 0.778 | 26.350 | 2.280 | 0.392 | 2.410 | 1.590 | 0.890 |
| 23 | 0.759 | 0.854 | 53.680 | 4.040 | 0.442 | 2.680 | 1.580 | 0.560 |
| 24 | 0.819 | 0.838 | 91.530 | 2.940 | 0.499 | 1.820 | 1.490 | 0.640 |
| AVG[1] | 0.850 | 0.833 | 38.391 | 2.489 | 0.483 | 2.307 | 1.650 | 0.751 |
| STD[2] | 0.089 | 0.070 | 19.151 | 0.543 | 0.141 | 0.390 | 0.307 | 0.133 |
| %, STD/AVG | 10 | 8 | 50 | 22 | 29 | 17 | 19 | 18 |

Note:
[1]the average of initial resistance
[2]the standard derivation of initial resistance From the data shown in table 3, the circuit protection devices made in Examples 1–2 of this invention have a lower STD/AVG %, 8–10%, than those of the comparative Examples 4–6, 22–50%, wherein those comparative Examples comprise merely grafted polyethylene and carbon black. The STD/AVG % of the circuit protection devices made in Examples 1–2 of this invention are also lower than those of the comparative Examples 7–9, 22–50%, wherein those comparative Examples comprise HDPE, ionomer (Surlyn 8670) and carbon black. This indicates that the device of this invention has a better resistance uniformity and a production yield than those of the comparative Examples.

The invention shall not be limited by the embodiments described above, which are exemplary and which can be modified in various ways within the scope of protection defined by the appended patent claims.

What is claimed is:

1. A cocktail-type positive temperature coefficient (PTC) polymer blend composition, comprising:

(a) a polymer mixture containing (i) a crystalline grafted polymer selected from a group consisting of grafted polyolefin, grafted polyolefin derivatives, and grafted copolymers of polyolefin and polyolefin derivatives, said grafted polymer being grafted by a polar group selected from a group consisting of carboxylic acids and derivatives thereof, (ii) a crystalline non-grafted polymer selected from a group consisting of non-grafted polyolefin, non-grafted polyolefin derivatives, and non-grafted copolymers of polyolefin and polyolefin derivatives, said non-grafted polymer having a melting point substantially the same as that of said grafted polymer, and (iii) an ionomer of an ionic copolymer of said crystalline non-grafted polymer and an ionized unsaturated carboxylic acid; and (b) a conductive particulate material.

2. The composition according to claim 1, wherein said crystalline grafted polymer is selected from a group consisting of grafted HDPE, grafted LDPE, grafted LLDPE, grafted MDPE, and grafted PP.

3. The composition according to claim 1, wherein said crystalline non-grafted polymer is selected from a group consisting of non-grafted HDPE, non-grafted LDPE, non-grafted LLDPE, non-grafted MDPE, and non-grafted PP.

4. The composition according to claim 1, wherein said grafted copolymer of polyolefin and polyolefin derivatives is selected from a group consisting of grafted EVA, grafted EBA, grafted EAA, grafted EMAA, and grafted EMA.

5. The composition according to claim 1, wherein said non-grafted copolymer of polyolefin and polyolefin derivatives is selected from a group consisting of non-grafted EVA, non-grafted EBA, non-grafted EAA, non-grafted EMAA, and non-grafted EMA.

6. The composition according to claim 1, wherein said polar group is selected from a group consisting of maleic anhydride, acrylic acid and acetic acid.

7. The composition according to claim 1, wherein said unsaturated carboxylic acid is selected from a group consisting of maleic anhydride, acrylic acid and acetic acid.

8. The composition according to claim 1, wherein said ionized unsaturated carboxylic acid is ionized by neutralization with a metal ion selected from a group consisting of sodium, potassium, zinc, calcium, magnesium, lithium, aluminum, nickel and chromium.

9. The composition according to claim 1, wherein said conductive particulate material is carbon black and has a structure grade <120, which is measured by the oil (DiButyl Phthalate) absorption method, and a particle size of 40–100 nm.

10. The composition according to claim 1, comprising 30–70% by weight said polymer mixture and 30–70% by weight said conductive material.

11. The composition according to claim 10, comprising 40–60% by weight said polymer mixture and 40–60% by weight said conductive material.

12. The composition according to claim 1, wherein said polymer mixture contains 10–80% by weight said crystalline grafted polymer, 10–80% by weight said crystalline non-grafted polymer, and 10–80% by weight said ionomer.

13. The composition according to claim 12, wherein said polymer mixture contains 30–50% by weight said crystalline grafted polymer, 25–35% by weight said crystalline non-grafted polymer, and 25–35% by weight said ionomer.

14. The composition according to claim 1, wherein said crystalline grafted polymer is grafted HDPE, said crystalline non-grafted polymer is non-grafted HDPE, and said ionomer is Surlyn 8670.

15. The composition according to claim 14, wherein said grafted HDPE is grafted by maleic anhydride.

16. The composition according to claim 15, wherein said grafted HDPE contains less than 1% by weight maleic anhydride.

17. A circuit protection device, comprising:

(a) a PTC element, having a cocktail-type PTC polymer blend composition as claimed in claim 1; and (b) two electrodes, connected respectively to two opposite sides of said PTC element and adapted to be connected to a power source.

18. The circuit protection device according to claim 17, wherein said electrodes are further connected to a conductive wire carrier or a conductive sheet.

* * * * *